US011812849B2

(12) United States Patent
Duggins et al.

(10) Patent No.: US 11,812,849 B2
(45) Date of Patent: Nov. 14, 2023

(54) BRACKET FOR DRAWER SLIDE

(71) Applicant: Tenn-Tex Plastics, Inc., Colfax, NC (US)

(72) Inventors: William Duggins, Kernersville, NC (US); Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 17/697,035

(22) Filed: Mar. 17, 2022

(65) Prior Publication Data

US 2022/0202180 A1 Jun. 30, 2022

Related U.S. Application Data

(63) Continuation of application No. 15/905,958, filed on Feb. 27, 2018, now abandoned.

(60) Provisional application No. 62/463,889, filed on Feb. 27, 2017, provisional application No. 62/471,563, filed on Mar. 15, 2017.

(51) Int. Cl.
*A47B 88/43* (2017.01)
*A47B 88/407* (2017.01)

(52) U.S. Cl.
CPC ..... *A47B 88/43* (2017.01); *A47B 88/407* (2017.01); *A47B 2210/09* (2013.01)

(58) Field of Classification Search
CPC .... A47B 88/43; A47B 88/407; A47B 2210/09
See application file for complete search history.

(56) References Cited

U.S. PATENT DOCUMENTS

| | | | |
|---|---|---|---|
| 939,005 | A | 11/1909 | Goedeke |
| 1,313,113 | A | 8/1919 | Pleister |
| 1,572,295 | A | 2/1926 | Kofsky |
| 2,938,759 | A | 5/1960 | Mutchnik et al. |
| 3,544,053 | A | 12/1970 | Ingalls |
| 4,037,897 | A | 7/1977 | Siggia |
| 4,039,131 | A | 8/1977 | Perrault et al. |
| D260,590 | S | 9/1981 | Hobson |
| 4,441,773 | A | 4/1984 | Leiper |
| 5,002,249 | A | 3/1991 | Meyer |
| 5,025,545 | A | 6/1991 | Brown |
| 5,312,078 | A | 5/1994 | Marsh |
| D357,623 | S | 4/1995 | Davis |
| D361,846 | S | 8/1995 | Tekannon |
| D364,331 | S | 11/1995 | Leek |
| 5,549,376 | A | 8/1996 | Domenig |
| 5,601,350 | A | 2/1997 | Roeck et al. |

(Continued)

OTHER PUBLICATIONS

"Ovis Corner Brace, dated Sep. 1, 2011, [online], [site visited May 11, 2015]. Available from Internet, URL:http://www.ovisonline.com/Corner-Braces-C45.aspx".

(Continued)

*Primary Examiner* — Hanh V Tran
(74) *Attorney, Agent, or Firm* — Myers Bigel, P.A.

(57) ABSTRACT

A bracket for mounting a drawer slide to a cabinet rear wall includes: a main panel; at least one lower guide attached to an extending from a lower edge of the main panel; at least one upper guide attached to the main panel above the lower guide to form a gap configured to receive a drawer slide; a latch extending from the main panel adjacent to the lower guide, the latch including an upwardly-extending hook; and openings in the main panel sized and positioned to receive fasteners to fasten the bracket to a rear wall of a cabinet.

18 Claims, 7 Drawing Sheets

(56) References Cited

U.S. PATENT DOCUMENTS

| | | | |
|---|---|---|---|
| D393,408 | S | 4/1998 | Mladineo |
| 5,906,344 | A | 5/1999 | Atkinson et al. |
| 6,368,694 | B1 | 4/2002 | Marsh et al. |
| 6,485,120 | B1 | 11/2002 | Pomerleau et al. |
| D490,295 | S | 5/2004 | Neider et al. |
| 6,854,817 | B1 | 2/2005 | Simon |
| D537,337 | S | 2/2007 | Brockington et al. |
| D656,007 | S | 3/2012 | Swoish et al. |
| 8,616,664 | B2 | 12/2013 | Hightower |
| D744,317 | S | 12/2015 | Densberger et al. |
| D753,465 | S | 4/2016 | Marsh |
| D753,983 | S | 4/2016 | Toye |
| D770,269 | S | 11/2016 | Lavelle |
| D784,790 | S | 4/2017 | Marsh |
| 10,314,398 | B2 | 6/2019 | Bowman et al. |
| 2002/0101143 | A1 | 8/2002 | Crooks et al. |
| 2002/0180321 | A1 | 12/2002 | Chen et al. |
| 2003/0132688 | A1 | 7/2003 | Domenig |
| 2005/0225219 | A1 | 10/2005 | Chen et al. |
| 2006/0243636 | A1 | 11/2006 | Robichaud et al. |
| 2012/0145845 | A1 | 6/2012 | Hightower |
| 2013/0278125 | A1 | 10/2013 | Lang et al. |
| 2015/0216366 | A1 | 8/2015 | Knoll |
| 2015/0296982 | A1 | 10/2015 | Chen et al. |
| 2016/0081473 | A1 | 3/2016 | Cheng et al. |
| 2017/0172300 | A1 | 6/2017 | Bowman et al. |

OTHER PUBLICATIONS

"Poplar Square Plastic Corner Blokc Brace, dated Nov. 5, 2010, [online], [site visited May 11, 2015]. Available from the Internet, URL:http://www.poplarsquare.com/braces.html".

BRACKET FOR DRAWER SLIDE

RELATED APPLICATION

The present application is a continuation of and claims priority to U.S. patent application Ser. No. 15/905,958, filed Feb. 27, 2018, which claims priority from and the benefit of U.S. Provisional Patent Application Nos. 62/463,889, filed Feb. 27, 2017, and 62/471,563, filed Mar. 15, 2017, the disclosures of which are hereby incorporated herein by reference in full.

FIELD OF THE INVENTION

The present invention is directed generally to furniture, and more particularly to cabinets with sliding drawers and trays.

BACKGROUND OF THE INVENTION

Many cabinets, particularly those found in kitchens, include drawers for storing various items. Often, drawers are mounted to the cabinet with elongate drawer slides that are fixed to the drawer. Each drawer slide has a slide member fixed to the drawer that slidably engages a stationary member that is fixed to the walls of the cabinet (often either the slide member or the stationary member includes a small wheel that facilitates sliding motion). Some of such cabinets include multiple drawers, which can be disposed in vertically stacked fashion, side-by-side fashion, or both.

Some drawers have slides that are mounted on the underside of the drawer (so-called "undermounted" drawer slides). These drawer slides may be preferred in some environments because they are less exposed than side-mounted drawer slides (and therefore may be less exposed to damage) and may avoid taking up space on either side of the drawer. In some embodiments, undermounted slides may have mechanisms that cause the drawer to close automatically without slamming. An exemplary undermounted drawer slide is the DYNAMIC NT slide, available from Mepla-Alfit, Reinheim, Germany; another is illustrated in U.S. Pat. No. 6,854,817 to Simon.

An undermounted drawer slide may be mounted to a side wall of the cabinet, or may be mounted at either end to the front or rear wall. If the slide is to be mounted to the front or rear wall, often the wall will include mounting holes for receiving screws or other fasteners inserted through a mounting bracket that connects to the slide. However, the tolerances of cabinets and drawer slides are typically insufficiently precise to consistently position the holes in the mounting bracket for easy mounting of the drawer slide. Also, some currently popular cabinets have drawers that are configured such that, when the drawer is closed, the front face of the drawer is substantially flush with the front face of the cabinet. In such instances, it is typically desirable that the drawer be mounted precisely to ensure the flush relationship of the drawer face and cabinet face. However, achieving a flush relationship may be difficult due to inconsistencies in the thickness of the drawer face, the length of the cabinet and drawer slides, and the thickness of the front wall of the cabinet. In view of the foregoing, it may be desirable to provide a mounting technique that addresses these difficulties.

SUMMARY

As a first aspect, embodiments of the invention are directed a bracket for mounting a drawer slide to a cabinet rear wall comprising: a main panel; at least one lower guide attached to an extending from a lower edge of the main panel; at least one upper guide attached to the main panel above the lower guide to form a gap configured to receive a drawer slide; a latch extending from the main panel adjacent to the lower guide, the latch including an upwardly-extending hook; and openings in the main panel sized and positioned to receive fasteners to fasten the bracket to a rear wall of a cabinet.

As a second aspect, embodiments of the invention are directed to a cabinet assembly comprising: a front wall and a rear wall; a drawer slide mounted to the front wall; and a bracket as described above mounted to the rear wall. The drawer slide includes a rear edge portion with a window, and the rear edge portion is captured by the upper guide and the lower guide, and the hook of the latch is inserted into the window.

DETAILED DESCRIPTION

Figure 1:
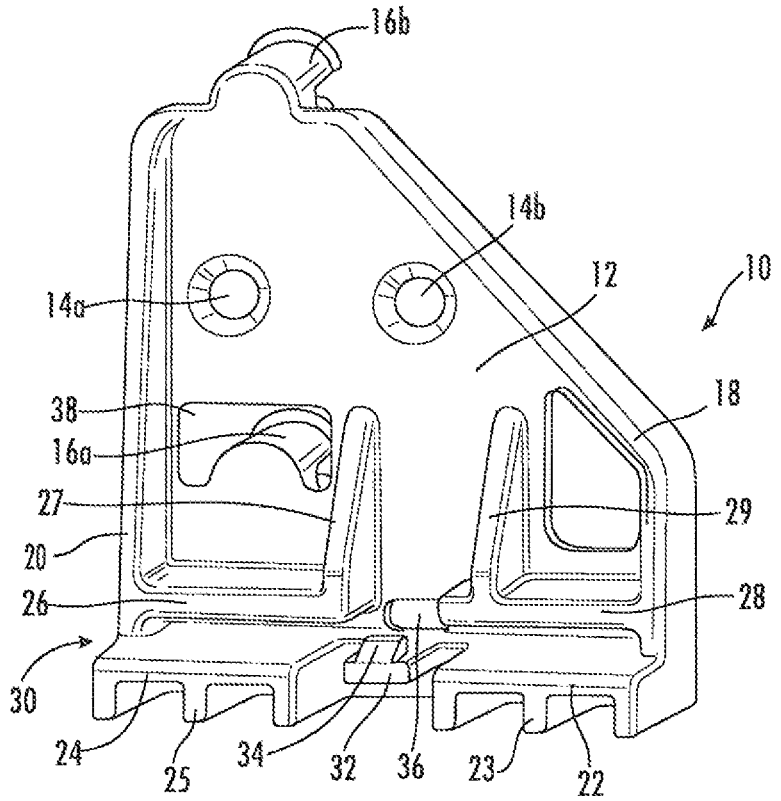
FIG. 1 is a perspective view of a drawer slide bracket according to embodiments of the invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, a drawer slide bracket, designated broadly at 10, is shown in FIG. 1. The bracket 10 includes a main panel 12 that is generally trapezoidal in shape. Two screw holes 14*a*, 14*b* are located in the main panel 12 at approximately the same height. A split boss 16*a* extends horizontally from the upper edge of the main panel 12, and a second split boss 16*b* extends horizontally from the main panel 12 below the screw holes 14*a*, 14*b*; the split bosses 16*a*, 16*b* are vertically aligned. Ribs 18, 20 extend on the side edges of the main panel 12.

Horizontal lower guides 22, 24 extend from the lower edge of the main panel 12. Ribs 23 support the guide 22 from underneath, and ribs 25 support the guide 24 from underneath. Horizontal upper guides 26, 28 are located above the lower guides and form a horizontal gap 30. Gussets 27, 29 support the inward edges of the upper guides 26, 28. cantilevered latch 32 having a hook 34 extends generally coplanar with the lower guides 22, 24, with the and includes a hook 34 extending into the gap 30.

The bracket 10 is typically formed of a thermoplastic, such as ABS or polystyrene, and may be injection-molded. If so, hole 36 in the main panel just above the latch 32 can facilitate simplified molding of the bracket 10, as can hole 38 above the split boss 16*b*.

Figure 2:
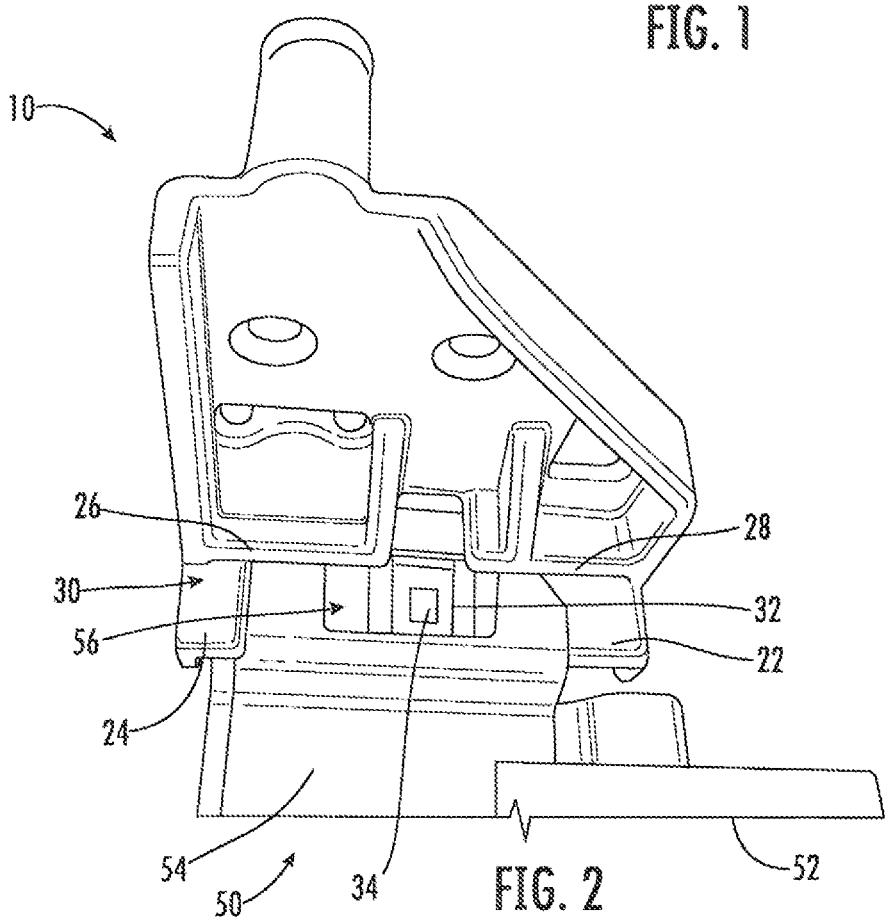
FIG. 2 is a top perspective view of the bracket of FIG. 1 attached to a drawer slide.
Figure 3:
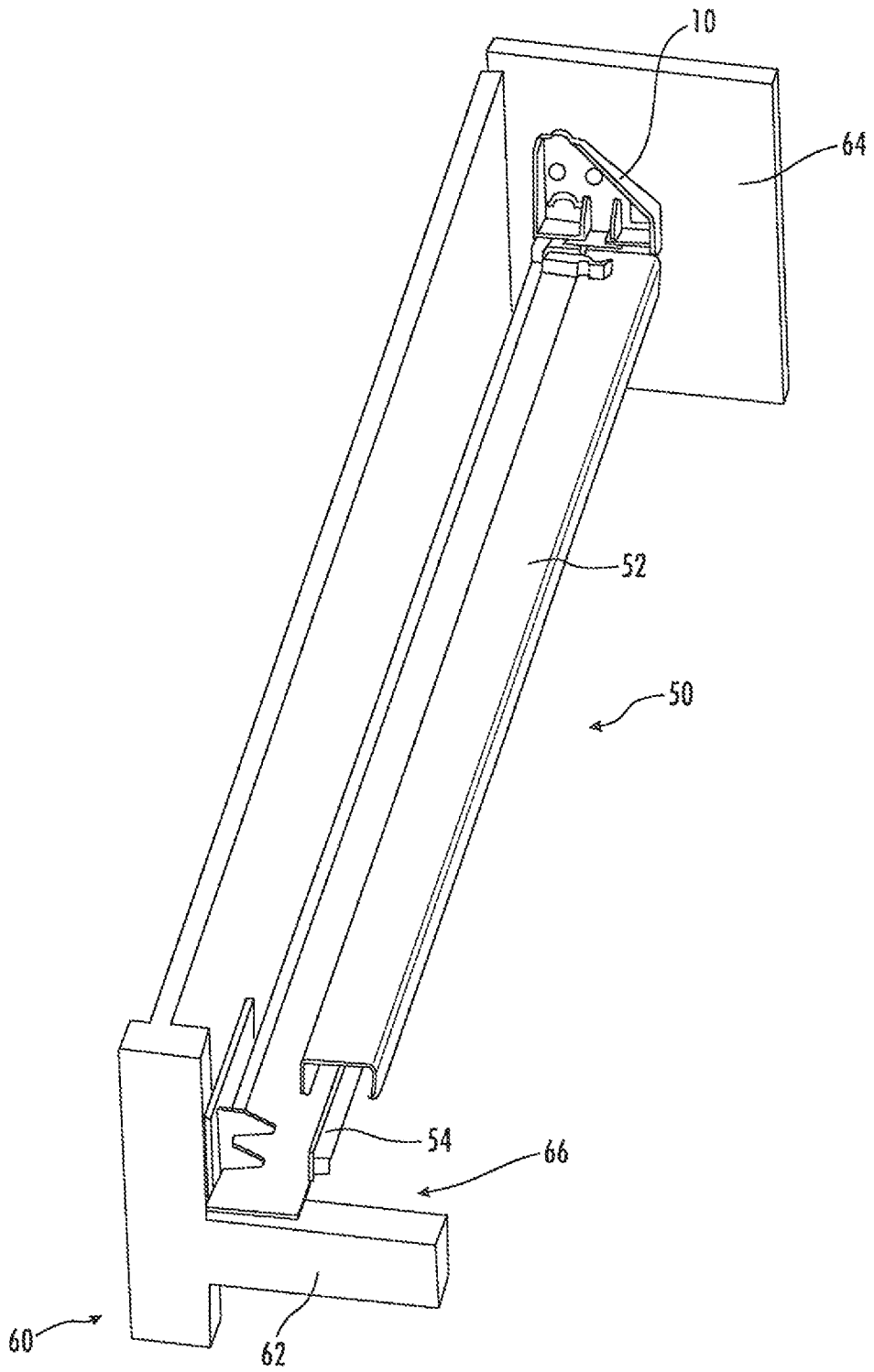
FIG. 3 is a top perspective view of the bracket and drawer slide of FIG. 2 installed in a cabinet.

Referring now to FIGS. 2 and 3, the bracket 10 can be employed to mount a conventional drawer slide, designated broadly at 50, within a cabinet 60. The bracket 10 can be mounted to the rear wall 64 of the cabinet 60, either via screws (not shown) inserted into the holes 14*a*, 14*b* in the main panel 12, or via the insertion of the split bosses 16*a*, 16*b* into pre-formed holes in the rear wall 64. The drawer slide 50 is then mounted onto the bracket 10 via a stationary member 54; at its rear end, the stationary member 54 has a window 56 that receives the hook 34 of the latch 32. Notably, the window 56 is wider than the hook 34 of the latch 32. The edges of the stationary member 54 are received in the gap 30 in the bracket 10, wherein the gap 30 is typically sized to provide a slight snug or interference fit with the stationary member 54. The forward end of the stationary member 54 is mounted to the front wall 62 of the cabinet 60. A slide member 52 of the drawer slide 50 is mounted on the stationary member 54 and can slide easily thereon.

During installation of a drawer or tray (not shown) in the cabinet 60, the drawer/tray is fixed to the slide member 52 (and to the slide member of a second drawer slide mounted on the opposite side of the cabinet 60). (Typically, the second drawer slide is mounted to the rear wall 64 of the cabinet 60 with a bracket that is the mirror image of the bracket 10). In some instances the slide members 52 are attached to the drawer/tray first, then installed on the stationary members 54; in other instances the entire drawer slide 50 may be installed prior to mounting of the drawer/tray. In either instance, once installed, the drawer/tray can slide relative to the cabinet 60 due to the sliding action of the slide members 52 relative to the stationary members 54.

The bracket 10 can facilitate mounting of the drawer slide and drawer/tray. The bracket 10 can be mounted with either the split bosses 16*a*, 16*b*, the holes 14*a*, 14*b*, or both, depending on the preference of the installer. Also, the latch 32 enables the drawer slide 50 to be mounted on the bracket 10 quickly and easily. Moreover, because the hook 34 of the latch 32 is narrower than the window 34, the drawer slide 50 can be adjusted side-to-side to fit properly within the cabinet 60. As illustrated in FIG. 3, the forward end of the stationary member 54 of the drawer slide 50 is mounted at the vertex of the lower and side edges of an opening 66 in the front wall 62 of the cabinet 60 (this is typical of a so-called "face-frame" cabinet), The tolerances of the opening 66, the drawer/tray, and the drawer slides 50 are ordinarily relatively loose, such that the positions of the side edge of the opening 66, the front and rear ends of stationary member 54, and the somewhat imprecise; thus, the ability of the stationary member 54 of the drawer slide 50 to be adjusted side-to-side can significantly ease installation of the drawer slide 50 and, in turn, installation of the drawer or tray.

Figure 4:
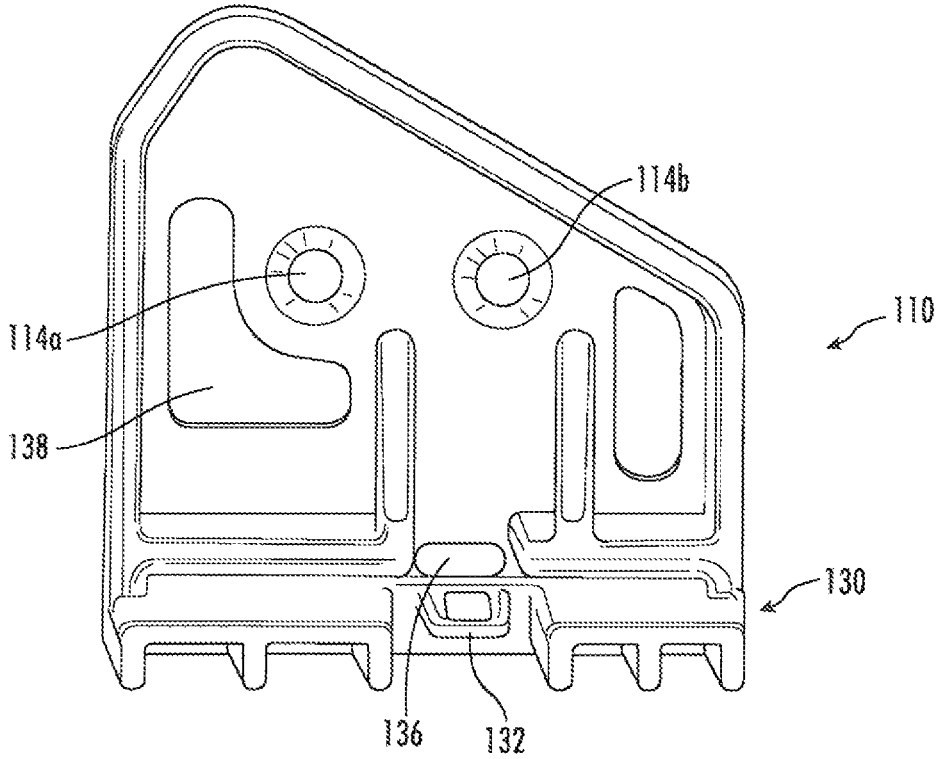
FIG. 4 is a top perspective view of a drawer slide bracket according to alternative embodiments of the invention.
Figure 9:
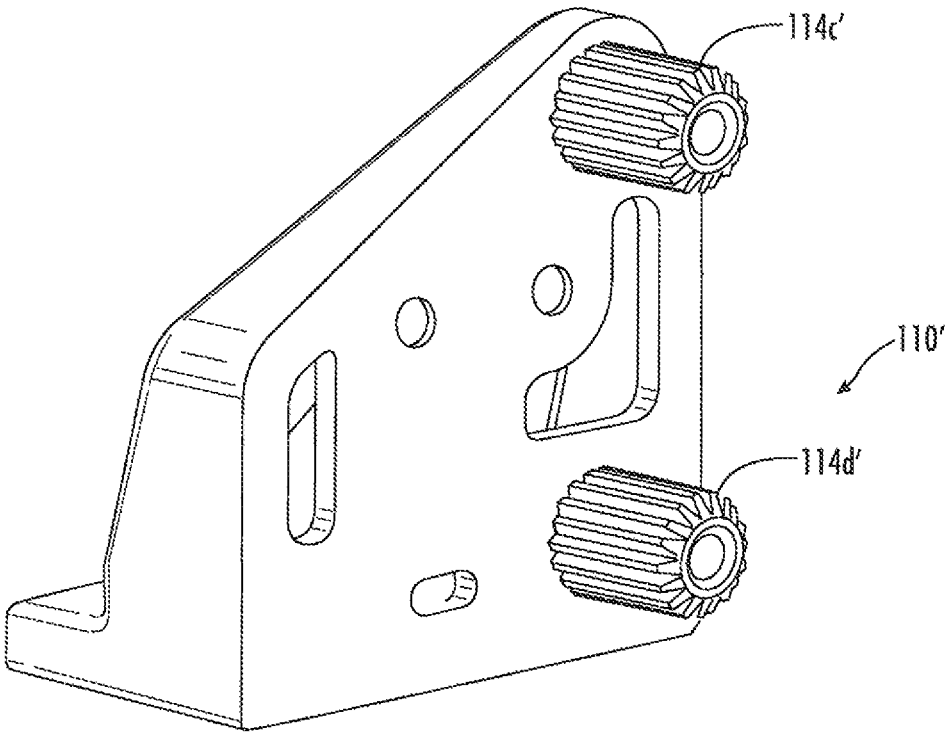
FIG. 9 is a rear perspective view of a drawer slide bracket similar to the bracket of FIG. 4 according to embodiments of the invention.

Those skilled in this art will appreciate that the bracket 10 may take alternative forms. Referring now to FIG. 4, another bracket, designated broadly at 110, is illustrated therein. The bracket 110 is similar to the bracket 10 with the exception that split bosses 16*a*, 16*b* are omitted, the screw holes 114*a*, 114*b* are relocated slightly, and the holes 136, 138 in the main panel 112 take a different shape. The bracket 110 is mounted to the rear wall of a cabinet via screws inserted through the holes 114*a*, 114*b*. The stationary member of a drawer slide can be mounted to the latch 132 and in the gap 130 as described above. An alternative bracket 110' that includes mounting dowels 114*c*', 114*d*' is shown in FIG. 9.

Figure 5:
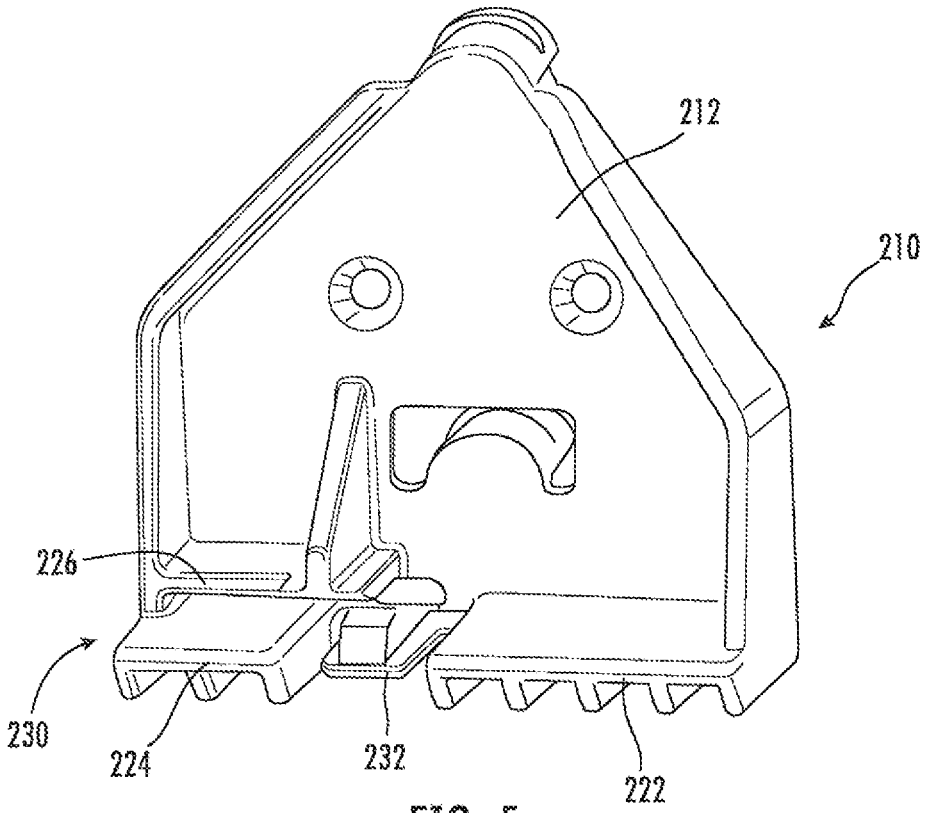
FIG. 5 is a top perspective view of a drawer slide bracket according to further embodiments of the invention.

Referring now to FIG. 5, another bracket, designated broadly at 210, is shown therein. The bracket 210 has a generally pentagonal main panel 212, and has only one upper guide 226 (i.e., there is no second upper guide as in the brackets 10, 110), which extends partially over the latch 232. Thus, the gap 230 that receives the end of the stationary member of the drawer slide extends only between the lower guide 224 and the upper guide 226, with space being present above the lower guide 222. Otherwise, the bracket 210 functions similarly to the brackets 10, 110.

Figure 6:
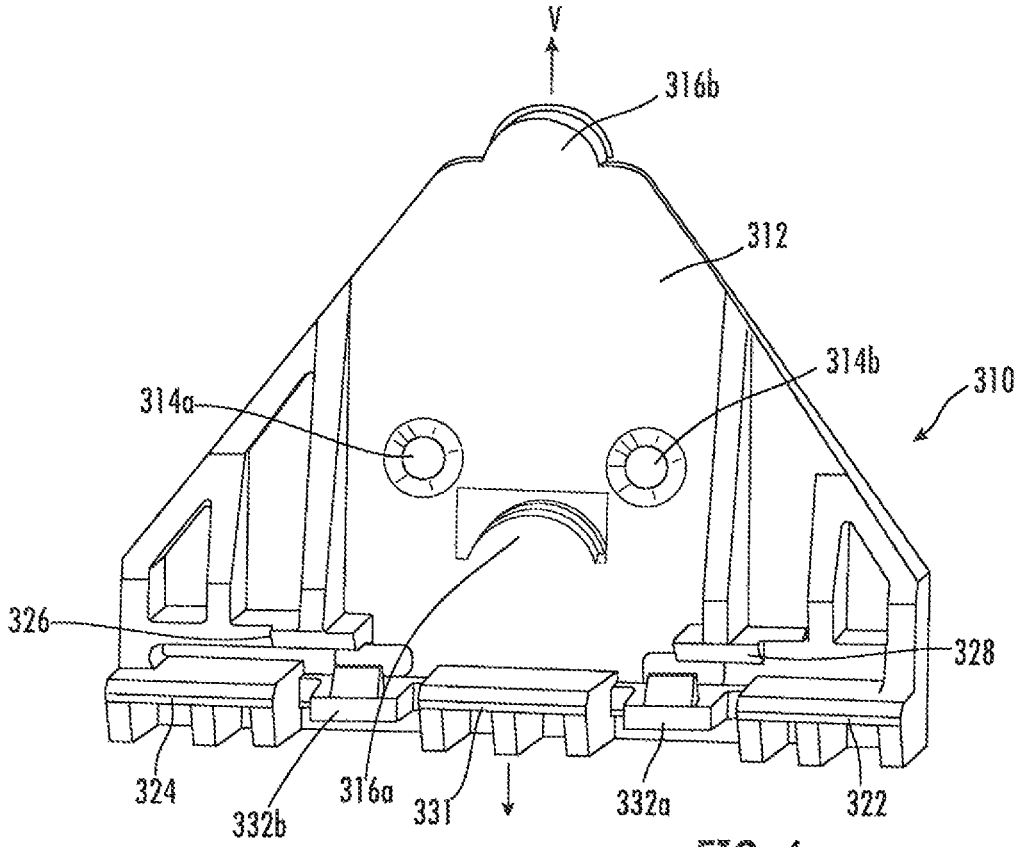
FIG. 6 is a top perspective view of a universal drawer slide bracket according to embodiments of the invention.

Referring now to FIG. 6, a universal drawer slide bracket, designated broadly at 310, is shown therein. The bracket 310 has a generally pentagonal main panel 312 and is "universal" in the sense that it can be used on either side of a cabinet (i.e., there is no need for separate "right hand" and "left hand" brackets, but instead two universal brackets may be used). As such, the bracket 310 has mirror symmetry about a vertical axis V. The bracket 310 includes screw holes 314*a*, 314*b*, split bosses 316*a*, 316*b*, lower guides 322, 324, and upper guides 326, 328. A central platform 331 is present between the lower guides 322, 324. Two latches 332*a*, 332*b* are located between the central platform 331 and respective lower guides 322, 324. The upper guides 328, 326 are located so that they partially overlie their respective lower guides 322, 324 and latches 332*a*, 332*b*.

In use, the bracket 310 is mounted to the rear wall of the cabinet via either the split bosses 316*a*, 316*b* or the screw holes 314*a*, 314*b*. The stationary member of the drawer slide is then mounted to the appropriate latch 332*a*, 332*b*, with the corresponding upper guide 326, 328 providing the snug/interference fit described above. Because the bracket 310 is universal, the same bracket 310 can be employed on each side of the cabinet, which can simplify ordering/inventory for the installer.

Figure 7:
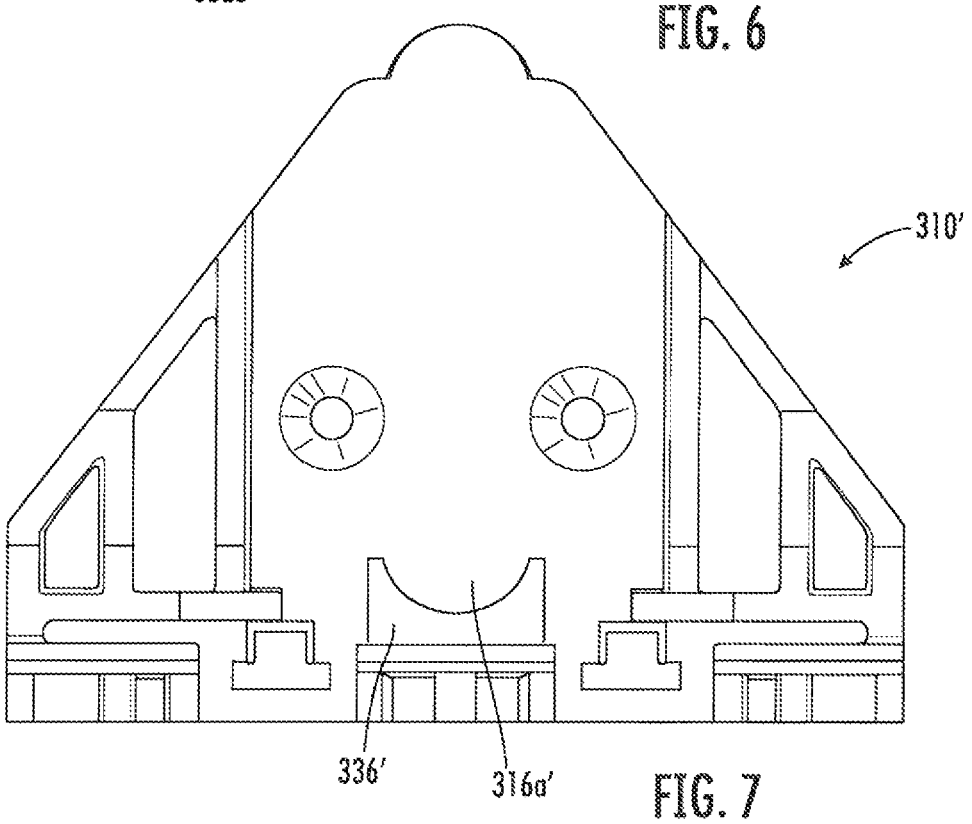
FIG. 7 is a top perspective view of a universal drawer slide bracket according to additional embodiments of the invention.

Referring now to FIG. 7, a similar universal bracket 310' is shown therein. The bracket 310' is identical to the bracket 310 with the exception that the hole 336' is positioned below (rather than above) the split boss 316*a'*.

Figure 8:
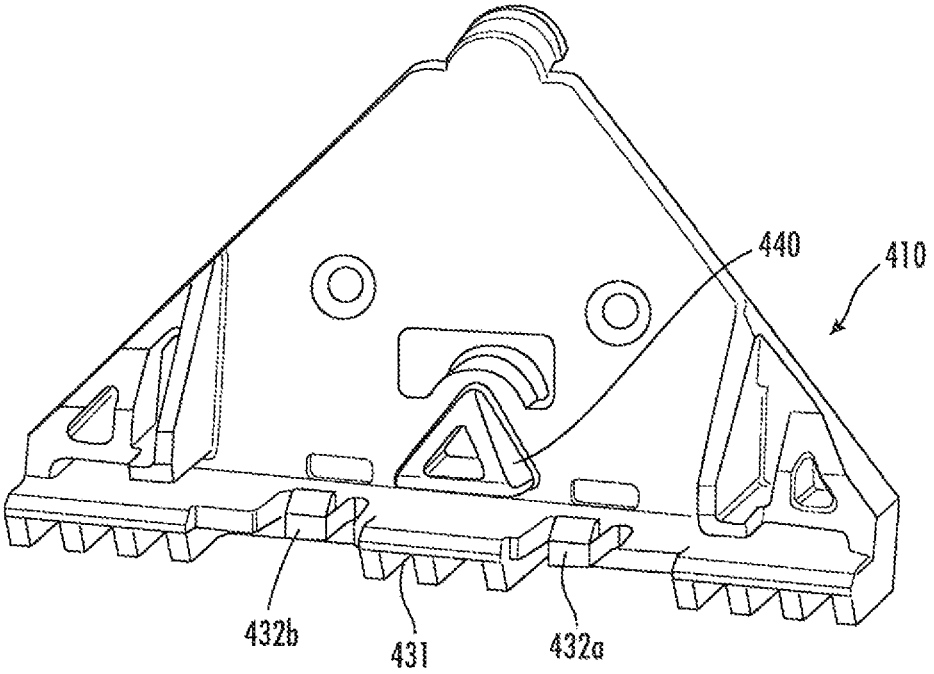
FIG. 8 is a top perspective view of a universal drawer slide bracket according to further embodiments of the invention.

Referring now to FIG. 8, another universal bracket, designated broadly at 410, is shown therein. The bracket 410 is similar to the bracket 310 with the exception that the bracket 410 includes a central upper guide 440 that is positioned above the central platform 431. As a result, the central upper guide 440 is in position to provide a snug/interference fit to the portion of the stationary member of the drawer slide that overlies the central platform 431, and can do so whether the stationary member is mounted to the latch 432*a* or the latch 432*b*.

Figure 10:
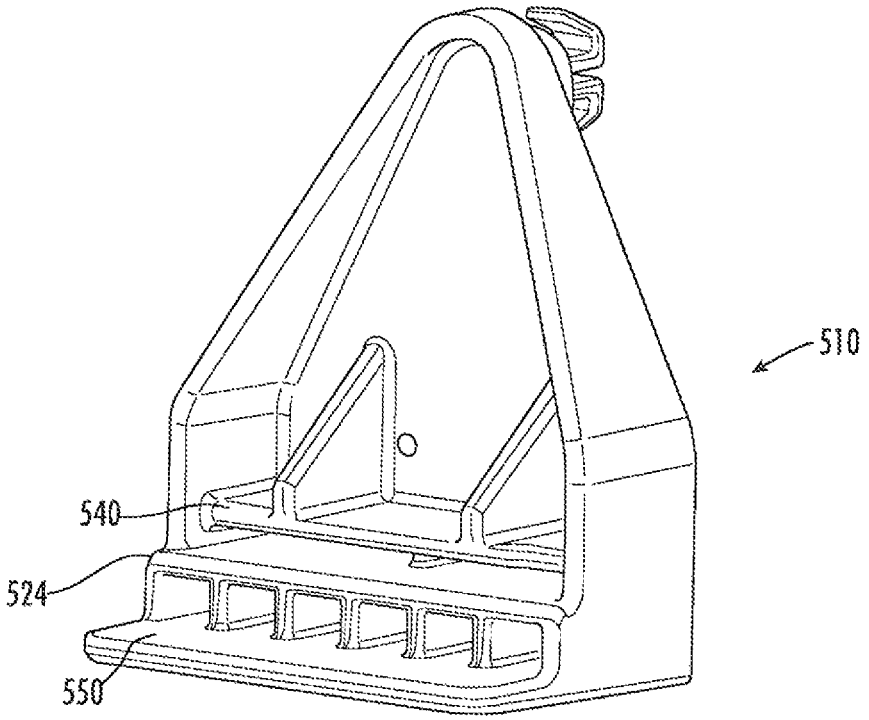
FIG. 10 is a front perspective view of a drawer slide bracket according to additional embodiments of the invention.
Figure 11:
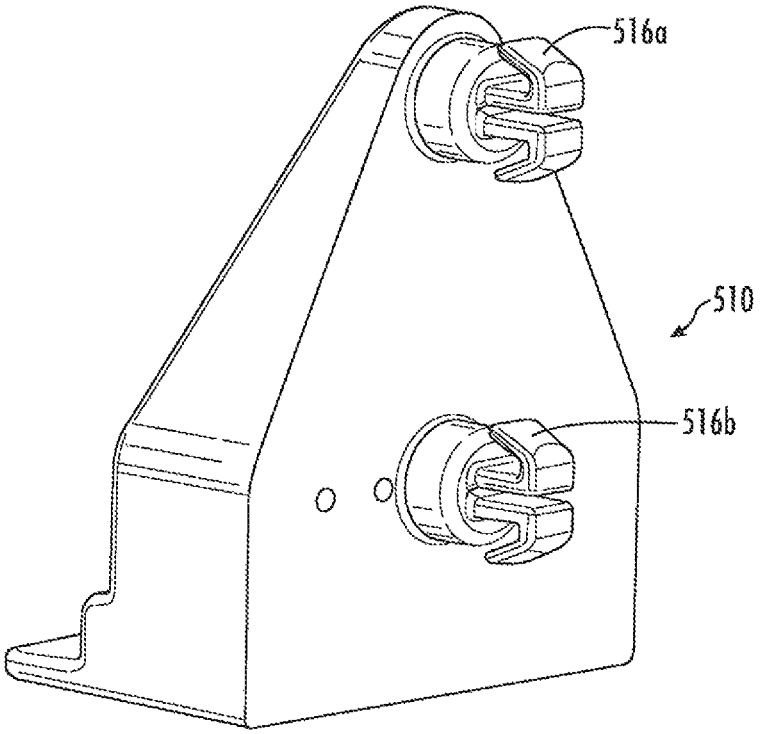
FIG. 11 is a rear perspective view of the drawer slide bracket of FIG. 10.
Figure 12:
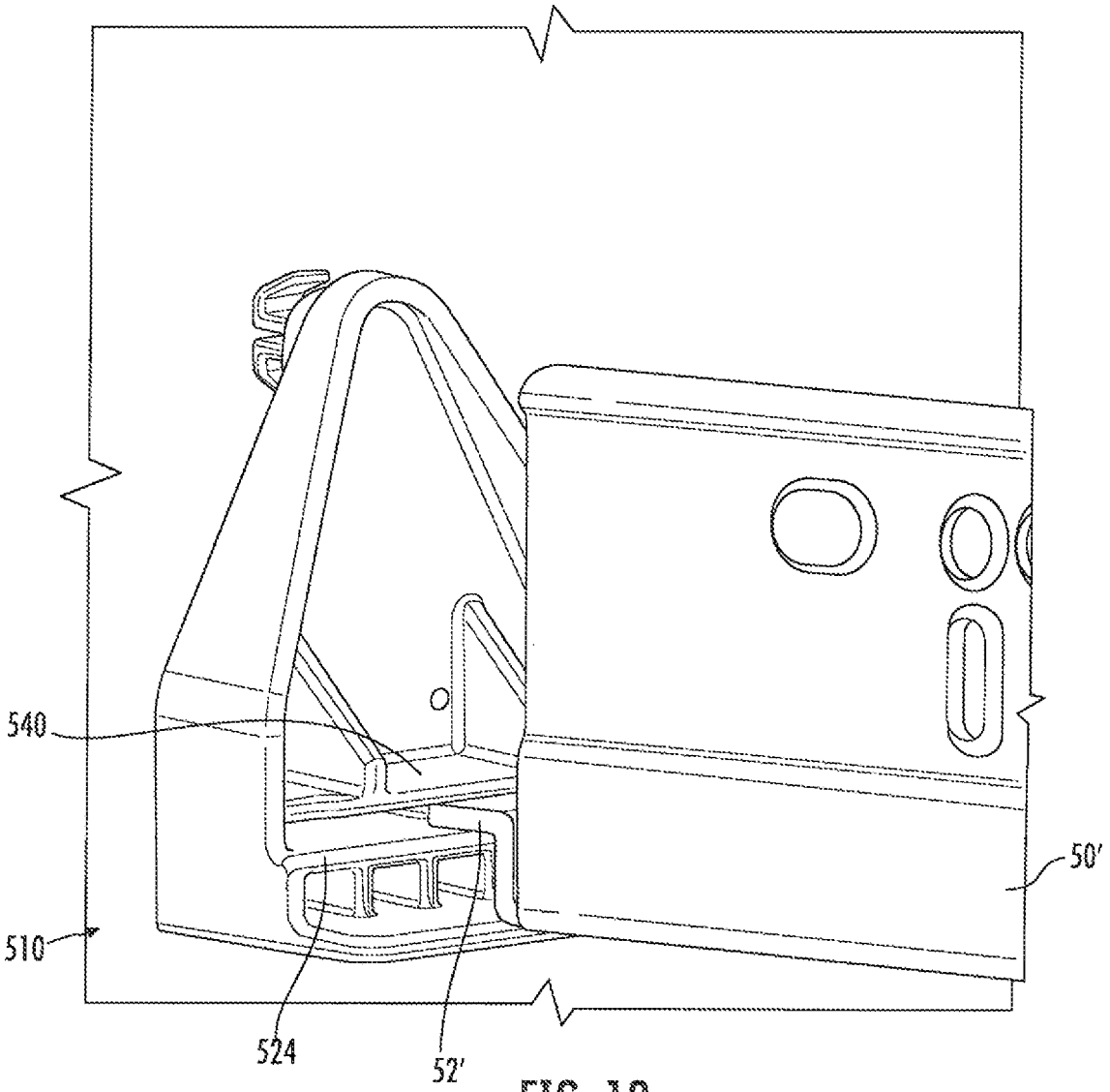
FIG. 12 is a front perspective view of the drawer slide bracket of FIGS. 10 and 11 with a drawer slide mounted thereto.

Referring now to FIGS. 10 and 11, another universal drawer slide bracket, designated broadly at 510, is shown therein. The bracket 510 is somewhat similar to the bracket 410 shown in FIG. 8, but instead of relying on a latch to assist with the interconnection of the drawer slide to the bracket 510, the bracket 510 has an upper guide 540 and a lower guide 524 that each span the width of the bracket 510. A tongue of a drawer slide can slide between the upper and lower guides 540, 524 and is retained therein via an interference fit. A floor 550 is positioned below the lower guide 524 (supported by a number of ribs 526) and extends beyond the lower guide 524 to provide support to the drawer slide from underneath (this is shown in FIG. 12, wherein the drawer slide 50' has a tongue 52'). The bracket 510 is mounted to the cabinet via split boss latches 516*a*, 516*b*).

The above examples are merely illustrative of the many applications of the brackets and assemblies of present invention. Although only a few embodiments of the present invention have been described herein, it should be understood that the present invention might be embodied in many other specific forms without departing from the spirit or scope of the invention. Therefore., the present examples and embodiments are to be considered as illustrative and not restrictive, and the invention may be modified within the scope of the appended claims.

That which is claimed is:

1. A bracket for mounting a drawer slide to a cabinet rear wall, comprising:

a main panel;

at least one lower guide attached to and extending from a lower edge of the main panel;

at least one upper guide attached to the main panel above the lower guide to form a gap configured to receive a drawer slide;

a cantilevered latch extending from the main panel and generally coplanar with the lower guide, the latch including an upwardly-extending hook; and openings in the main panel sized and positioned to receive fasteners to fasten the bracket to a rear wall of a cabinet;

wherein the at least one upper guide at least partially overlies the latch.

2. The bracket defined in claim 1, wherein the at least one lower guide is two lower guides.

3. The bracket defined in claim 2, wherein the at least one upper guide is two upper guides.

4. The bracket defined in claim 1, wherein the at least one lower guide is three lower guides.

5. The bracket defined in claim 4, wherein the at least one upper guide is at least two upper guides.

6. The bracket defined in claim 1, further comprising at least one split boss configured to be inserted into a pre-formed hole in the cabinet rear wall.

7. The bracket defined in claim 1, wherein the bracket has mirror symmetry about a vertical axis.

8. A cabinet assembly, comprising:

a front wall and a rear wall;

a drawer slide mounted to the front wall;

a bracket as defined in claim 1 mounted to the rear wall;

wherein the drawer slide includes a rear edge portion with a window, wherein the rear edge portion is captured by the upper guide and the lower guide, and the hook of the latch is inserted into the window.

9. The cabinet assembly defined in claim 8, wherein the window has a width that is greater than a width of the hook.

10. The cabinet assembly defined in claim 8, wherein the drawer slide includes a stationary member and a slide member, and the stationary member includes the rear edge portion.

11. The cabinet assembly defined in claim 10, wherein the front wall has an opening, and the stationary member is mounted in the opening.

12. The cabinet assembly defined in claim 8, wherein the at least one lower guide is two lower guides.

13. The cabinet assembly defined in claim 12, wherein the at least one upper guide is two upper guides.

14. The cabinet assembly defined in claim 8, wherein the at least one lower guide is three lower guides.

15. The cabinet assembly defined in claim 14, wherein the at least one upper guide is at least two upper guides.

16. The cabinet assembly defined in claim 8, further comprising at least one split boss configured to be inserted into a pre-formed hole in the cabinet rear wall.

17. The cabinet assembly defined in claim 8, wherein the bracket has mirror symmetry about a vertical axis.

18. The bracket defined in claim 1, wherein the main panel includes an aperture in the main panel just above the latch.

* * * * *